US008621709B2

(12) United States Patent
Conrad

(10) Patent No.: US 8,621,709 B2
(45) Date of Patent: Jan. 7, 2014

(54) MULTI-STRUT CLEANING HEAD

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 1321 days.

(21) Appl. No.: 11/953,355

(22) Filed: Dec. 10, 2007

(65) Prior Publication Data

US 2008/0209671 A1 Sep. 4, 2008

Related U.S. Application Data

(60) Provisional application No. 60/893,982, filed on Mar. 9, 2007, provisional application No. 60/869,586, filed on Dec. 12, 2006.

(51) Int. Cl.
*A47L 9/02* (2006.01)

(52) U.S. Cl.
USPC ..... 15/415.1

(58) Field of Classification Search
USPC ..... 15/415.1, 320, 321, 322, 339, 349, 351, 15/379, 389
See application file for complete search history.

(56) References Cited

U.S. PATENT DOCUMENTS

| | | | | |
|---|---|---|---|---|
| 869,542 | A | 10/1907 | Bergens | |
| 1,601,774 | A | 1/1926 | Scheffer | |
| 1,795,933 | A | 3/1931 | Cripe | |
| 2,210,950 | A | 8/1940 | Replogle | |
| 2,613,242 | A | 10/1952 | Shumaker et al. | |
| 2,618,007 | A | 11/1952 | Fuller | |
| 2,633,597 | A | 4/1953 | Turner | |
| 3,082,466 | A | 3/1963 | Tucker et al. | |
| D213,066 | S | 12/1968 | Wright | |
| D258,211 | S | 2/1981 | Martin | |
| 4,262,384 | A | 4/1981 | Bowers | |
| 4,393,536 | A | 7/1983 | Tapp | |
| 4,426,751 | A | 1/1984 | Nordeen | |
| 4,939,808 | A * | 7/1990 | Roden et al. | 15/322 |
| 5,018,240 | A | 5/1991 | Holman | |
| 5,077,862 | A | 1/1992 | Rench | |
| 5,123,141 | A | 6/1992 | Erickson et al. | |
| 5,134,752 | A | 8/1992 | Shipman | |
| 5,718,016 | A | 2/1998 | Sung | |

(Continued)

FOREIGN PATENT DOCUMENTS

| | | |
|---|---|---|
| CA | 2241644 | 12/1998 |
| CA | 2377512 | 9/2003 |

(Continued)

OTHER PUBLICATIONS

International Search Report for PCT/CA2007/002210, dated May 1, 2008.

(Continued)

*Primary Examiner* — Robert Scruggs
(74) *Attorney, Agent, or Firm* — Bereskin & Parr LLP/S.E.N.C.R.L., s.r.l.; Phillip C. Mendes da Costa

(57) ABSTRACT

A cleaning head for a surface cleaning apparatus has a plurality of struts extending from a front chamber having a dirty air inlet to a rear chamber having a transition duct that is in communication with a filtration apparatus of a surface cleaning apparatus by a dirty fluid outlet. One or more of the struts comprises an airflow passage. In one embodiment, no outer casing is provided surrounding the struts.

32 Claims, 18 Drawing Sheets

(56) References Cited

U.S. PATENT DOCUMENTS

| | | | | |
|---|---|---|---|---|
| 5,946,771 | A | 9/1999 | Bosyj et al. | |
| 6,003,196 | A | 12/1999 | Wright et al. | |
| 6,039,817 | A | 3/2000 | Payne | |
| 6,058,559 | A | 5/2000 | Yoshimi et al. | |
| 6,807,708 | B2 | 10/2004 | Roney et al. | |
| 6,813,807 | B2 | 11/2004 | Ibbertson et al. | |
| 2001/0054355 | A1 | 12/2001 | Embree et al. | |
| 2002/0124346 | A1* | 9/2002 | Steiner et al. | 15/384 |
| 2002/0129460 | A1* | 9/2002 | Roney et al. | 15/351 |
| 2004/0168282 | A1 | 9/2004 | Hitzelberger et al. | |
| 2005/0022333 | A1* | 2/2005 | McDowell et al. | 15/320 |
| 2006/0179604 | A1* | 8/2006 | Boddy et al. | 15/377 |
| 2007/0163076 | A1* | 7/2007 | Grey | 15/415.1 |
| 2008/0028570 | A1* | 2/2008 | Cascio | 15/351 |

FOREIGN PATENT DOCUMENTS

| | | | |
|---|---|---|---|
| DE | 4035411 | | 5/1992 |
| EP | 285096 | A3 | 10/1988 |
| EP | 1597961 | A1 | 11/2005 |
| GB | 2378643 | A | 2/2003 |
| GB | 2419278 | A | 4/2006 |
| GB | 2458063 | B | 3/2010 |
| JP | 02-194570 | | 7/2002 |
| WO | 2004073476 | A1 | 9/2004 |

OTHER PUBLICATIONS

Supplementary European Search Report for EP 078555492, May 12, 2010.

* cited by examiner

MULTI-STRUT CLEANING HEAD

CROSS REFERENCES TO RELATED APPLICATIONS

This application claims priority from U.S. Provisional Patent Applications 60/893,982 (filed on Mar. 9, 2007), and 60/869,586 (filed on Dec. 12, 2006), both of which are incorporated herein by reference in their entirety.

FIELD OF THE INVENTION

The invention relates to a cleaning head for a surface cleaning apparatus. In one preferred embodiment, the invention relates to a cleaning head, which comprises a plurality of airflow passages extending between a front portion and a rear portion. In another preferred embodiment, a plurality of struts that are not surrounded by an exterior casing extend between a front portion and a rear portion, wherein one or more of the struts may define airflow passages.

BACKGROUND OF THE INVENTION

Surface cleaning apparatuses, such as vacuum cleaners, typically comprise a surface cleaning head, which engages a surface, such as floor, and draws in dirt. The surface cleaning head generally comprises a front portion having a dirty fluid inlet, and a rear portion connectable to the remainder of the surface cleaning apparatus. Fluid communication between the front portion and the rear portion is provided by an airflow passage. The airflow passage is provided in a housing or casing extending between the front portion and the rear portion, and which extends laterally across the entire surface cleaning head. See for example, U.S. Pat. No. 6,003,196 to Wright.

SUMMARY OF THE INVENTION

In one broad aspect, a cleaning head for a surface cleaning apparatus is provided. The cleaning head comprises a front portion having at least one dirty fluid inlet. The cleaning head further comprises a rear portion connectable to a surface cleaning apparatus and having at least one dirty fluid outlet. A plurality of struts extend between the front portion and the rear portion. At least one, preferably at least two, and more preferably all of the struts each comprise an airflow passage extending between the front portion and the rear portion. At least two adjacent, and more preferably all of the struts are at least partially spaced apart, and define an open area between the adjacent struts. When the cleaning head is positioned on a surface, the surface is visible through the open area.

Embodiments in accordance with this broad aspect may be advantageous because if an airflow passage becomes blocked or clogged, the remainder of the airflow passages may still provide fluid communication between the front portion and the rear portion. Therefore, if a blockage occurs in an airflow passage, the surface cleaning apparatus may remain operational.

Additionally, due to the plurality of struts and the open area therebetween, a cleaning head in accordance with this broad aspect may not require a structural housing enclosing the airflow passages. Therefore, the cleaning head may be lighter, and have reduced material costs as compared to a cleaning head comprising a housing.

Additionally, in use, a cleaning head in accordance with this broad aspect may allow a user to view a relatively large portion of the surface being cleaned. That is, because a user may view the surface being cleaned through the open area between adjacent struts, the user may be able to see whether dirt or other material has been picked up with a pass of the surface cleaning head.

Additionally, the use of a plurality of air flow passages may decrease the back pressure in the air flow passage through the cleaning head since the minimum cross sectional area of the air flow passage may be increased. In conventional designs, a single passage is provided and the transverse cross sectional area is typically limited due to the passage having to be placed in a space between other components in the cleaning head, such as the suction motor, the brush drive motor and the like. The use of multiple passages enables a larger cumulative cross sectional area to be provided.

In accordance with this broad aspect, there is provided a cleaning head for a surface cleaning apparatus, comprising:

(a) a front portion having at least one dirty fluid inlet;

(b) a rear portion connectable to a surface cleaning apparatus and having at least one dirty fluid outlet; and, (c) a plurality of struts extending between the front portion and the rear portion, at least one of the struts comprises an air-flow passage extending between the front portion and the rear portion, and at least two adjacent struts being at least partially spaced apart and defining an open area between the adjacent struts;

whereby when the cleaning head is positioned on a surface, the surface is visible through the open area.

In some embodiments at least two of the struts each comprise an airflow passage extending between the front portion and the rear portion.

In some embodiments, the front portion has a longitudinally extending front chamber and each strut that defines an airflow passage comprises an intake portion in fluid communication with the longitudinally extending front chamber. In further embodiments, the intake portion of each strut that defines an airflow passage is spaced from the intake portion of at least one other strut. Such embodiments may be advantageous because relatively even suction may be provided across the front portion. Therefore, dirt may be drawn into the surface cleaning head from all regions of the front portion. This is particularly advantageous to improve edge cleaning if struts defining air flow passages are positioned adjacent the laterally opposed sides of the front chamber.

In some embodiments the rear portion has a longitudinally extending rear chamber and each strut that defines an airflow passage further comprises an outlet in fluid communication with the longitudinally extending rear chamber. In further embodiments, the outlet of each strut is spaced from the outlet of at least one other strut. The rear portion is preferably circular in transverse section. An advantage of this design is that the dirt suspended in the airflow stream will tend to be retained in the air as the airflow stream is redirected to the dirty fluid outlet. The outlet from the air flow passages in the struts to the rear chamber may be tangential to create a cyclonic flow in the rear chamber. Advantageously, the use of cyclonic action will permit the airflow stream to clean the sidewalls of the rear chamber and reduce the tendency of entrained material to settle out and clog the passage.

In some embodiments, at least a portion of the longitudinally extending rear chamber is rotationally mounted in the cleaning head about a longitudinally extending axis. For example, a pivoting connector forming part of the rear chamber may be rotationally mounted to the surface cleaning head.

In some embodiments the cleaning head comprises between 2 and 8 struts. In some embodiments the cleaning head comprises 4 struts. In any embodiment each strut preferably comprises an airflow passage. In further embodiments, the plurality of struts are arranged to define an M.

In some embodiments at least some of the struts that define an airflow passage have a viewing portion with a visibility such that a user can view the interior thereof. In further embodiments, the portion is transparent. Such embodiments may be advantageous because, if a blockage occurs in an airflow passage, a user may be able to view the blockage, and therefore may be able to clear the blockage. The viewing portion is preferably provided on the lower surface of the struts. Accordingly, a user, who will typically only view the top surface of the cleaning head will be able to view a clean painted or finished surface of the cleaning head. If a clog occurs, a user may be alerted by an audio alert or otherwise as is known in the vacuum cleaner art. The user may then turn the cleaning head over to determine if the clog is in the cleaning head. It will be appreciated that the rear chamber may alternately or in addition also have a transparent viewing portion.

In some embodiments at least one of the struts that defines an airflow passage is openable. In further embodiments, at least one of the struts that defines an airflow passage has a clean out port. In some embodiments, each strut that defines an airflow passage has a clean out port. Such embodiments may be advantageous because if a blockage occurs, a user may be able to easily clear the blockage. Alternately, all of the passage in the strut may be openable. For example, the strut may comprise an upper section and a lower section wherein one of the upper and lower sections is moveably (e.g. pivotally) or removably mounted to the other. The sections may be secured together by any means known in the art, such as set screws, a latch, clamp or the like. The mating surfaces of the sections may have a gasket or the like to provide an air tight seal.

In some embodiments the front portion comprises a rotatably mounted brush mounted in the longitudinally extending front chamber, and a brush drive motor is positioned in a housing external to the front portion, the rear portion and the struts.

In some embodiments, the cleaning head has surface contacting members that define a plane, and at least some of the struts extend upwardly and rearwardly from the front portion to define a space between the at least some struts and the plane, and the housing for the brush drive motor is positioned in the space.

In some embodiments the surface cleaning head further comprises rear wheels positioned rearwardly of the rear portion and the dirty fluid outlet. In a further embodiment, the dirty fluid outlet is rotationally mounted to an upright section of an upright vacuum cleaner.

In another broad aspect, a cleaning head for a surface cleaning apparatus is provided. The cleaning head comprises a longitudinally extending front portion having at least one dirty fluid inlet. The cleaning head further comprises a longitudinally extending rear portion connectable to a surface cleaning apparatus and having at least one dirty fluid outlet. A plurality of airflow passages extend between the front portion and the rear portion. Each airflow passage has an inlet portion in flow communication with the front portion, and an outlet portion in flow communication with the rear portion. At least some of the inlet portions are connected to the longitudinally extending front portion at different locations.

Embodiments in accordance with this broad aspect may be advantageous because if an airflow passage becomes blocked or clogged, the remainder of the airflow passages may still provide fluid communication between the front portion and the rear portion. Therefore, if a blockage occurs in an airflow passage, the surface cleaning apparatus may remain operational.

Additionally, because at least some of the inlet portions are connected to the longitudinally extending front portion at different locations, relatively even suction may be provided across the front portion. Therefore, dirt may be drawn into the surface cleaning head from all regions of the front portion.

Additionally, the use of a plurality of air flow passages may decrease the back pressure in the air flow passage through the cleaning head since the minimum cross sectional area of the air flow passage may be increased. In conventional designs, a single passage is provided and the transverse cross sectional area is typically limited due the passage having to be placed in a space between other components in the cleaning head, such as the suction motor, the brush drive motor and the like. The use of multiple passages enables a larger cumulative cross sectional area to be provided.

In accordance with this broad aspect, there is provided a cleaning head for a surface cleaning apparatus, comprising:

(a) a longitudinally extending front portion having at least one dirty fluid inlet;

(b) a longitudinally extending rear portion connectable to a surface cleaning apparatus and having at least one dirty fluid outlet;

(c) a plurality of airflow passages extending between the front portion and the rear portion, each airflow passage having an inlet portion in flow communication with the front portion and an outlet portion in flow communication with the rear portion; and, (d) at least some of the inlet portions are connected to the longitudinally extending front portion at different locations.

In some embodiments, at least some of the outlet portions are connected to the longitudinally extending rear portion at different locations. In a further embodiment, the front portion has a longitudinally extending front chamber and the rear portion has a longitudinally extending rear chamber.

In some embodiments the cleaning head comprises between 2 and 8 airflow passages. In some embodiments the cleaning head comprises 4 struts, each comprising an airflow passage.

In some embodiments, the cleaning head is configured such that a user can view the interior of at least one of the airflow passages. In further embodiments, at least one of the airflow passages has a viewing portion with a visibility such that a user can view the interior thereof provided in a lower surface of the cleaning head.

In some embodiments, at least one of the airflow passages is openable. In further embodiments each airflow passage has a clean out port. In some embodiments, each strut that comprises an airflow passage has a clean out port.

In some embodiments the front portion comprises a rotatably mounted brush mounted in the longitudinally extending front chamber, and a brush drive motor is positioned in a housing external an exterior surface of the cleaning head In some embodiments, the longitudinally extending rear chamber is circular in transverse section.

In some embodiments at least a portion of the longitudinally extending rear chamber is rotationally mounted in the cleaning head about a longitudinally extending axis.

In some embodiments, the cleaning head further comprises rear wheels positioned rearwardly of the rear portion and the dirty fluid outlet.

In some embodiments, the dirt fluid outlet is rotationally mountable to an upright section of an upright vacuum cleaner.

BRIEF DESCRIPTION OF THE DRAWINGS

These and other advantages of the present invention will be more fully and particularly understood in connection with the following description of the preferred embodiments of the invention in which.

DETAILED DESCRIPTION OF THE INVENTION

Figure 1:
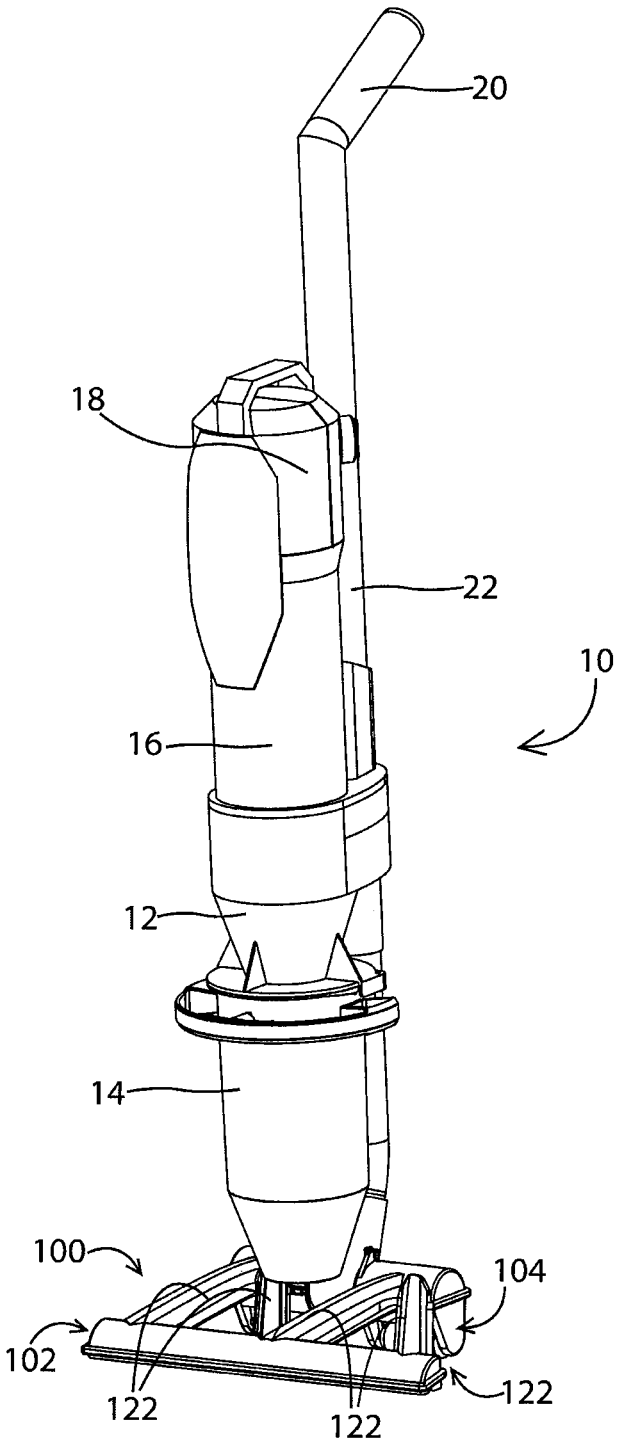
FIG. 1 is a perspective view of a surface cleaning apparatus comprising an embodiment of a cleaning head of the present invention.

Referring to FIG. 1, a surface cleaning apparatus 10 comprising an embodiment of a cleaning head 100 of the present invention is shown. In the embodiment shown, surface cleaning apparatus 10 is an upright vacuum cleaner comprising a cyclone 12, a dirt bin 14, a filter housing 16, a motor 18, and a handle 20, which are mounted to a backbone 22. Backbone 22 is tubular, and serves as an air-flow conduit between surface cleaning head 100, and the remainder of the surface cleaning apparatus 10. In other embodiments, surface cleaning apparatus 10 may be any other type of surface cleaning apparatus to which a cleaning head 100 of the present invention may be connectable, such as a canister type vacuum cleaner, a wet/dry vacuum cleaner, a central vacuum cleaner, a stick vac or a carpet extractor.

Figure 2:
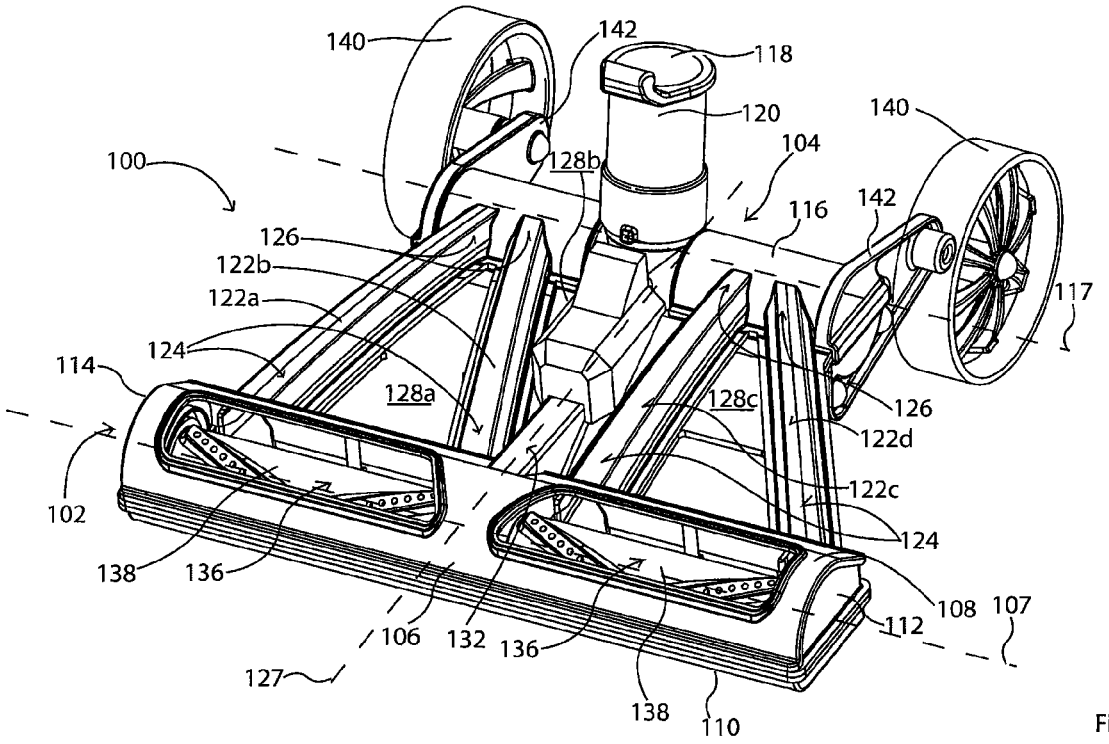
FIG. 2 is a perspective view of another embodiment of cleaning head of the present invention.

Referring to FIG. 2, cleaning head 100 comprises a front portion 102, and a rear portion 104. In the embodiment shown, front portion 102 comprises a longitudinally extending front chamber 106, extending along axis 107. Front chamber 106 comprises a top portion 108, a bottom portion 110, and two laterally opposed sides 112, 114. Front portion 102 comprises at least one dirty fluid inlet 115 preferably in a lower surface thereof (shown in FIG. 5), through which dirt, air, and/or other fluids are drawn into surface cleaning apparatus 10. In the embodiment shown, the dirt inlet 115 is defined in bottom portion 110, and extends across bottom portion 110 from side 112 to side 114. In an alternate embodiment, dirt inlet 115 may be otherwise configured. For example, cleaning head 100 may comprise two laterally spaced dirt inlets in bottom portion 110. Any configuration in the vacuum cleaner arts may be used.

In the embodiments shown, rear portion 104 comprises a longitudinally extending rear chamber 116, extending along axis 117. Rear chamber 116 has a dirty fluid outlet 118. It will be appreciated that more than one dirty fluid outlet 118 may be provided. It will be appreciated that more than one rear chamber 116 may be provided. For example, two longitudinally extending rear chambers 116, each extending part way across the rear of surface cleaning head 100 may be used.

In the preferred embodiment, rear chamber 116 is round or circular in transverse section (i.e. transverse to axis 117). In such embodiments, air or fluid passing through rear chamber 116 may travel in a swirling or cyclonic motion, which may cause the dirt suspended in the airflow stream to be retained in the air as the airflow stream is redirected to the dirty fluid outlet.

Rear chamber 116 is connectable to the remainder of surface cleaning apparatus 10 to provide fluid communication between the surface cleaning head 100 and the remainder of surface cleaning apparatus 10 via dirty fluid outlet 118. In some embodiments, rear portion 104 may be connectable to the remainder of surface cleaning apparatus 10 via a neck 120, which is mountable to or in rear chamber 116 (as exemplified in FIG. 5). Neck 120 may be connected to a hose (e.g. in the case of a canister or whole house vacuum cleaner or a carpet extractor) or a spine (e.g. in the case of an upright or stick vacuum cleaner). Accordingly, in the case of an upright vacuum cleaner, neck 120 may be connected to rear chamber 116 at one end, and mountable to backbone 22 at the other end. Neck 120 thereby provides fluid communication between rear chamber 116 and backbone 22. In some embodiments, neck 120 may be configured to be rotatably mounted to backbone 22, such that surface cleaning head 100 is rotatable relative to the upright portion of surface cleaning apparatus 10

Neck 120 is preferably pivotally mountable to rear chamber 116 by a pivoting connector 150. In such a construction, an airtight connection is preferably provided such that no, or essentially no, air leaks into the airflow passage as neck 120 rotates. Accordingly, as exemplified in FIG. 5, opposed ends 153 of the transverse portion 152 of pivoting connector 150 may comprise sealing members, for example O-rings 154, positioned between pivoting connector 150 and the inner surface of rear portion 104, to sealingly connect pivoting connector 150 to rear portion 104.

A plurality of struts 122 extends between front portion 102 and rear portion 104. In the embodiment shown, cleaning head 100 comprises four struts 122*a*, 122*b*, 122*c*, and 122*d*. In other embodiments, other numbers of struts may be provided, for example between two and eight or more struts. In an embodiment wherein an outer casing is not provided to create a shell for the cleaning head (as exemplified in FIG. 1), then at least one, and preferably at least two of the struts 122 each comprise an airflow passage extending between front portion 102 and rear portion 104. In an alternate embodiment (not shown) an outer casing may be provided surrounding the struts. For example, the cleaning head may comprise upper and lower clamshell housings surrounding the front and rear chambers and the struts. In such a case at least two of the struts comprise airflow passages.

The struts that are airflow passages comprise an intake portion 124 in fluid communication with front portion 102, an outlet 126 in fluid communication with rear portion 104, and a passage extending therebetween. In the embodiment shown, each of the four struts comprises an air-flow passage. In an alternate embodiment, only some, e.g., two, of the struts may comprise an airflow passage, and the remaining struts do not comprise an airflow passage. The remaining two struts, and preferably all struts, provide structural members to result in surface cleaning head 100 having sufficient structural strength to functions as a surface cleaning head. It will be appreciated that reinforcing members (e.g., tie rods an cross struts) may be optionally provided.

In the preferred embodiment, wherein rear chamber 116 is round or circular in transverse section, one or more, and preferably each, of outlets 126 from the air flow passages in the struts 122 to the rear chamber 116 may be tangential to create a cyclonic flow in the rear chamber 116. This may permit the airflow stream to clean the sidewalls of the rear chamber 116 and reduce the tendency of entrained material to settle out and clog the passage.

The struts 122 may have a variety of configurations and any desired configuration may be used. In the preferred embodiment, at least two adjacent struts 122 are at least partially spaced apart, and define an open area 128 between the adjacent struts.

In the embodiment shown in FIGS. 1-4 and 6, the intake portion 124 of each of the struts 122 is spaced from the intake portions 124 of each other strut 122. That is, the intake portions 124 are connected to front chamber 106 at different locations. Additionally, the intake portions 124 of struts 122*a* and 122*d* are provided adjacent opposed sides 112 and 114 of front chamber 106, in order to provide improved edge cleaning by providing increased suction adjacent sides 112 and 114. Struts 122*a* and 122*d* are angled towards a central axis 127 of cleaning head 100, and struts 122*b* and 122*c* are angled away from central axis 127 (when viewed in the rearward direction, namely from the front portion to the rear portion). Additionally, the outlet 126 of each strut 122 is spaced from the outlet 126 of each other strut 122. That is, the outlets are connected to rear chamber 116 at different locations. The outlets of struts 122*a* and 122*b*, and struts 122*c* and 122*d* are substantially closer together than the outlets of struts 122*b* and 122*c*. This configuration of struts defines a shape similar to the letter M. In this embodiment, a substantially trapezoidal open space 128 is defined between struts 122*a* and 122*b*, between struts 122*b* and 122*c*, and between struts 122*c* and 122*d*.

Figure 3:
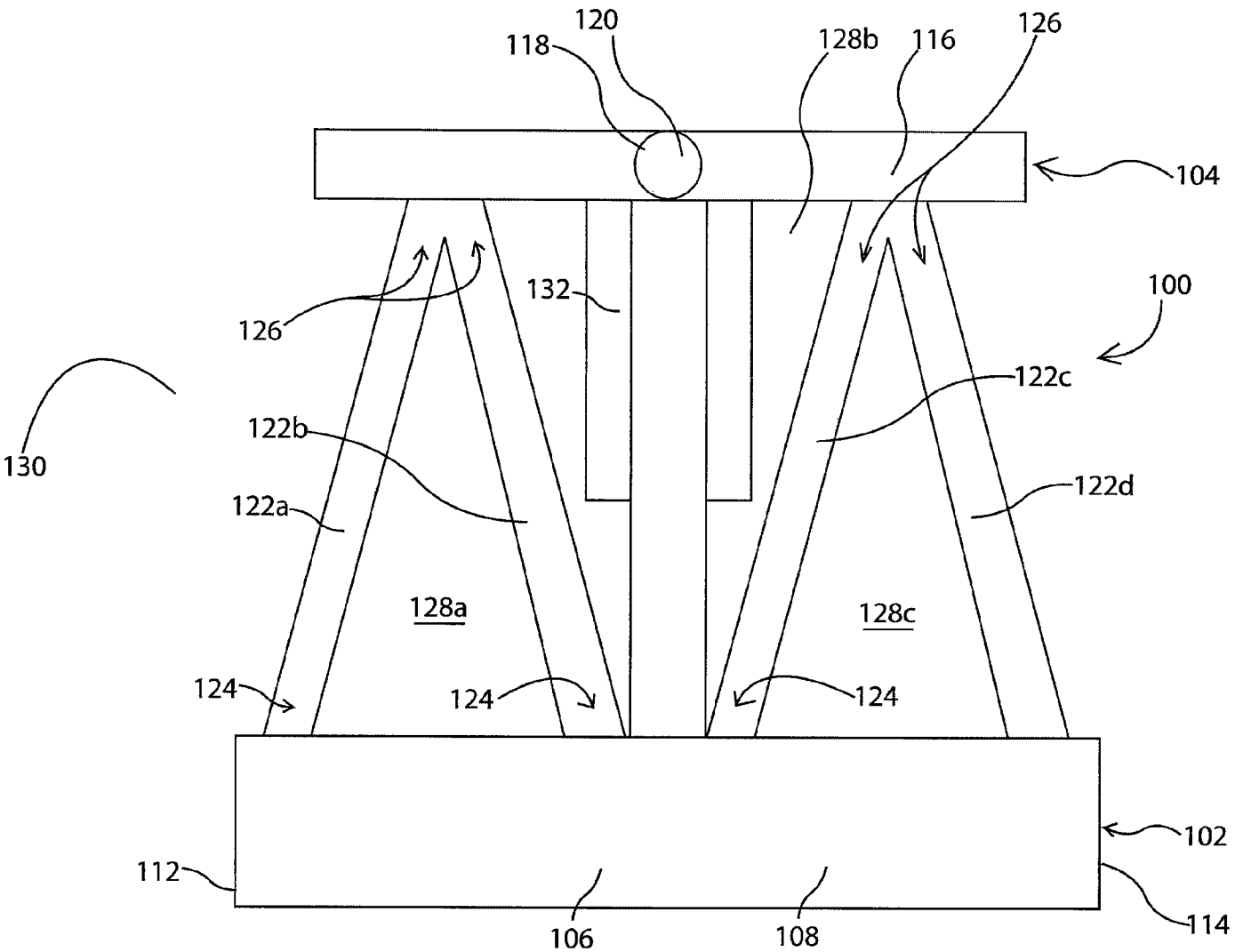
FIG. 3 is a top view of another embodiment of cleaning head of the present invention positioned on a surface.
Figure 4:
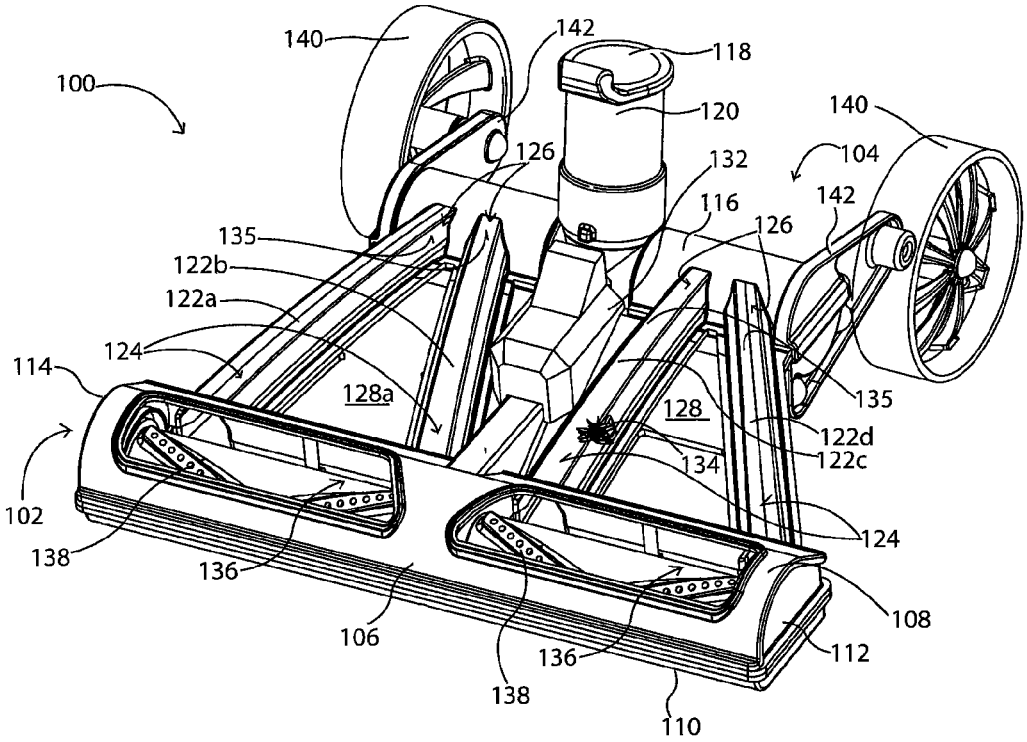
FIG. 4 is a perspective view of another embodiment of a cleaning head of the present invention.

In alternate embodiments, the struts 122 may be otherwise configured. For example, each strut may be substantially parallel to central axis 127, and may be equally spaced from each other, thereby defining rectangular open spaces. In another example, as shown in FIG. 3, the intake portion 124 of each strut 122 may be spaced from the intake portion 124 of each other strut, and the outlets 126 of struts 122*a* and 122*b* may be substantially adjacent each other or at least partially conjoined. The outlets 126 of struts 122*c* and 122*c* may further be substantially adjacent each other or at least partially conjoined, and spaced from the outlets 126 of struts 122*a* and 122*b*. In this embodiment, the struts may define a shape similar to the letter M. In other embodiments, the intake portions 124 of some of the struts may be substantially adjacent each other or partially conjoined. For example, in the embodiment of FIG. 5, the intake portions 124 of struts 122*c* and 122*d* are conjoined. In another example, cleaning head 100 may comprise two struts which are bifurcated or substantially Y-shaped, such that they each have 2 intake portions 124, and one outlet 126. In this embodiment, a single hexagonal open space may be defined between the struts 122. In other embodiments, the inlets of the struts may all be spaced apart (e.g., evenly paced along the front chamber) or spaced different distances apart or spaced adjacent each other. Alternately, or in addition, the outlets of the struts may all be spaced apart (e.g., evenly paced along the rear chamber) or spaced different distances apart or spaced adjacent each other. Accordingly, each strut 122 may independently be parallel to axis 127 or extend at an angle thereto.

Figure 9:
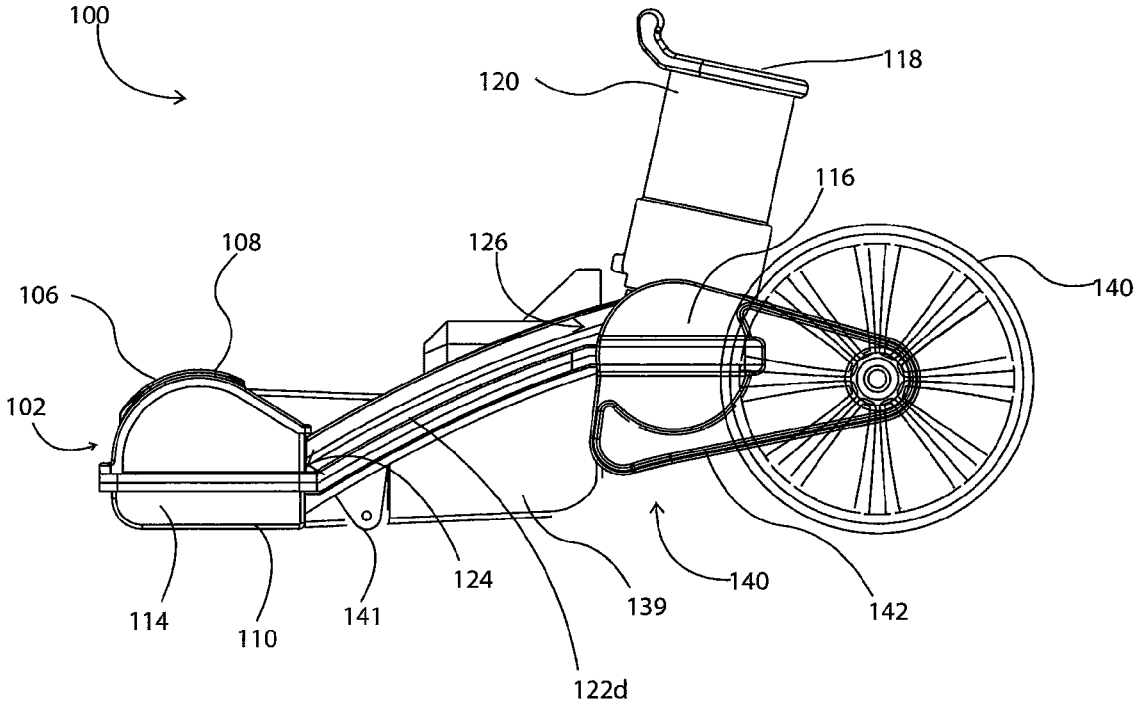
FIG. 9 is a side view of the cleaning head of FIG. 7.
Figure 10:
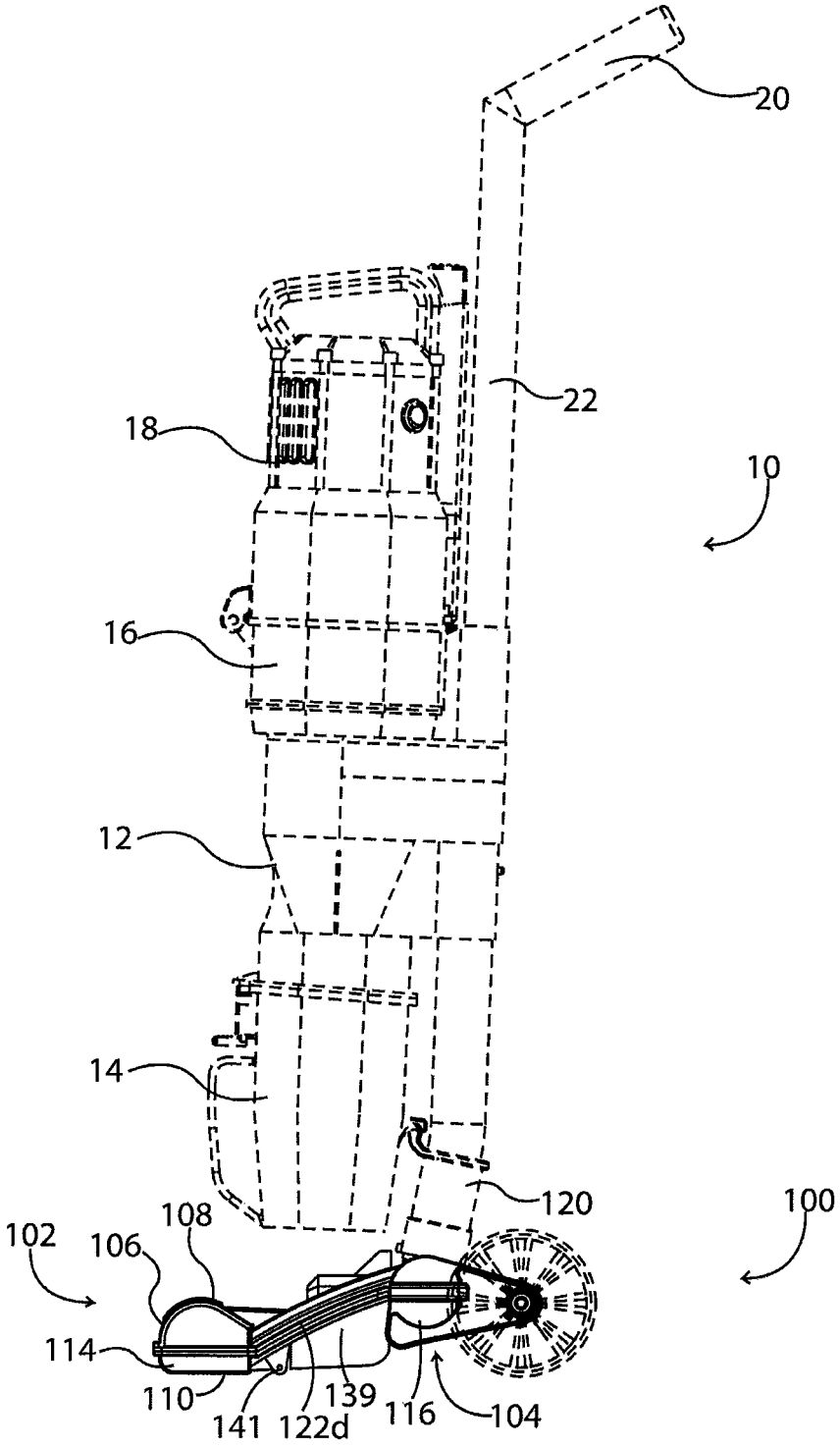
FIG. 10 is a side view of a surface cleaning apparatus comprising the surface cleaning head of FIG. 7.

In the embodiments shown, and as best exemplified in FIGS. 9 and 10, struts 122 are positioned and/or configured to provide an open area between struts 122 and surface 130. For example, struts 122 preferably extend rearwardly and upwardly from front portion 102. In alternate embodiments, struts may extend at other angles. For example, struts 122 may be parallel to surface 130. Struts 122 may extend from an upper portion of the front portion to an upper part of the rear portion. Alternately, or in addition, as shown in the embodiments of FIGS. 1-6, each of the struts may be substantially straight. However, in alternate embodiments, one or more of the struts 122 may be curved or bent. For example, one or more of the struts may curve laterally towards or away from axis 127 and/or curve upwardly or downwardly. For example, as shown in FIGS. 7-10, struts 122 extend rearwardly and upwardly from front portion to the rear portion. This configuration may be useful in embodiments wherein a brush drive motor is positioned underneath struts 122, as will be described subsequently.

In some embodiments, when the cleaning head is positioned on a surface 130, if no outer casing is provided or if an outer casing is transparent, then surface 130 is visible through one or more of the open area(s) 128. For example, referring to FIG. 3, open areas 128*a* and 128*c* are substantially devoid of material, such that when the cleaning head 100 is positioned on surface 130, the surface 130 is visible through open areas 128*a* and 128*c*.

It will be appreciated that if cleaning head 100 is not provided with an outer casing, then struts 122 comprise, or may consist of, the structural members that secure front and rear sections 102, 104 together. It will be appreciated that reinforcing members, e.g., metal tie rods and the like, may be provided to increase the structural integrity of cleaning head 100. For example, in the embodiments of FIGS. 2-4, open area 128*b* is partially filled by a rib 132, which extends between front portion 102 and rear portion 104, for providing additional structural integrity to cleaning head 100. Therefore, surface 130 is only partially visible through open area 128*b*.

In other embodiments, open area(s) 128 may be otherwise configured. For example, in the embodiments of FIGS. 1, 5 and 6, cleaning head 100 does not comprise a rib or other structural reinforcing member, and therefore surface 130 is equally visible through open areas 128*a*, 128*b*, and 128*c*. In another example, a web of material may extend fully or partially across one or more open area(s) 128, such that surface 130 is visible through only some of the open areas 128, or through only a portion of each open area 128.

In the preferred embodiment, at least some of the struts that define an airflow passage have at least a portion with a visibility such that a user can view the interior thereof. For example, in the embodiment shown in FIG. 4, wherein each of the four struts 122 defines an airflow passage, the entirety of each strut 122 is transparent. Thus, if a blockage 134 occurs in one or more struts, a user may be able to view the blockage 134.

In alternate embodiments, only some of the struts may have a viewing portion with a visibility such that a user can view the interior thereof. Furthermore, in some embodiments, only a portion of each strut may be transparent. For example, a top surface of each strut may be transparent, and preferably, the lower surface. The viewing portion may be openable to remove a clog. Alternately, the openable portion need not be transparent.

In some embodiments, one or both of front portion 102 and rear portion 104 may comprise a viewing portion with a visibility such that a user can view the interior thereof. For example, in the embodiments shown in FIGS. 2 and 4, front chamber 106 comprises two transparent portions 136 in the top portion 108 thereof. Preferably, rear portion 104 has a viewing portion, preferably on a lower surface thereof, so that a user can determine if there is a blockage in rear chamber 116. The viewing portion may be openable to remove a clog. Alternately, the openable portion need not be transparent.

In the preferred embodiment, transparent portions of cleaning head 100 are fabricated from a transparent plastic, such as polycarbonate for example. In alternate embodiments, transparent portions may be made from another material.

In some embodiments, cleaning head 100 may further comprise one or more brushes 138 for aiding in drawing dirt into the dirty fluid inlet 115. The brushes 138 may be rotatably mounted in front chamber 106, such that they roll along a surface on which cleaning head 100 is moved. In further embodiments, cleaning head 100 may comprise a brush drive motor mounted in the brushes 138. Alternately, a brush drive motor may be provided externally of front chamber 108. For example, as shown in FIGS. 7-10, struts 122 extend rearwardly and upwardly from the front portion to the rear portion, to define an open space therebelow and a brush drive motor is positioned in a housing 139 under struts 122 in this space. In a further alternate embodiment, no rotatable brush or the like, and alternately no brush, is provided. The brush drive motor may be drivingly connected to the brush 138 by a belt or any other drive member known in the art. An advantage of this design is that brush drive motor housing 139 is exposed to the ambient to assist in cooling the brush drive motor.

In some embodiments, cleaning head 100 may comprise one or more wheels or glides 140, for aiding in moving cleaning head 100 along a surface. In the embodiments shown, cleaning head 100 comprises two front wheels 141 and two rear wheels 140. Any configuration of wheels or glide members may be used.

In any particular embodiment, rear wheels 140 are preferably mounted to rear portion 104 via brackets 142, and extend rearwardly of surface cleaning head 10. This configuration may be particularly useful in embodiments wherein surface cleaning head 10 is mounted to an upright vacuum cleaner including a motor in the upright section. In such embodiments, wheels 140 and surface cleaning head 10 may provide a stable platform to the upright section, and prevent it from tilting or tipping rearwardly.

Figure 13:
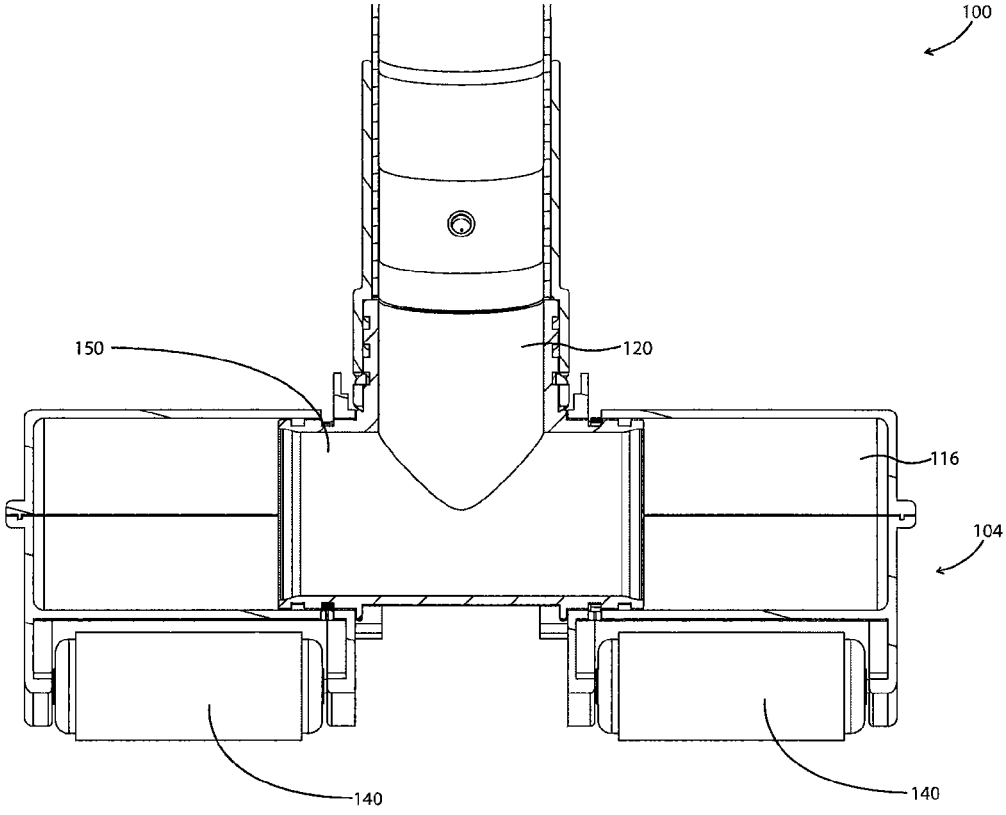

In alternate embodiments, as shown in FIG. 13, cleaning head 100 may comprise a plurality of wheels 140 positioned under rear chamber 116. In such embodiments, each wheel 140 may have its own axle, or the wheels 140 and mounted to a common axle. In such embodiments, wherein wheels 140 are positioned underneath a portion of cleaning head 100, wheels 140 may not be visible when surface cleaning apparatus 100 is in use. Accordingly, this may provide surface cleaning head 10 with a cleaner and more appealing appearance.

In some embodiments, one or more of the struts 122 which comprise an air-flow passage may comprise one or more clean out ports. For example, in the embodiment of FIG. 4, top surface 144 of each strut 122 may be removable from the remainder of the strut 122, thereby providing a clean out port for each strut 122. Thus, in order to clear blockage 134, a user may remove the top surface 144 of strut 122*c*, and manually remove blockage 134. In this embodiment, the top surface 144 is completely removable from each strut. Alternatively, as exemplified in FIGS. 11A-11F, a portion of one or more of the struts may pivot individually or with other portions, for example about a hinge or pivot pin (not shown), with respect to the remainder of surface cleaning head 100, to provide an openable window or door. For example, as exemplified in FIG. 11A, top surface 144 of each strut pivots away from the remainder of each strut 122 together with top portion 108 of front chamber 106 about a hinge provided at the front end of front chamber 106.

Figure 11A:
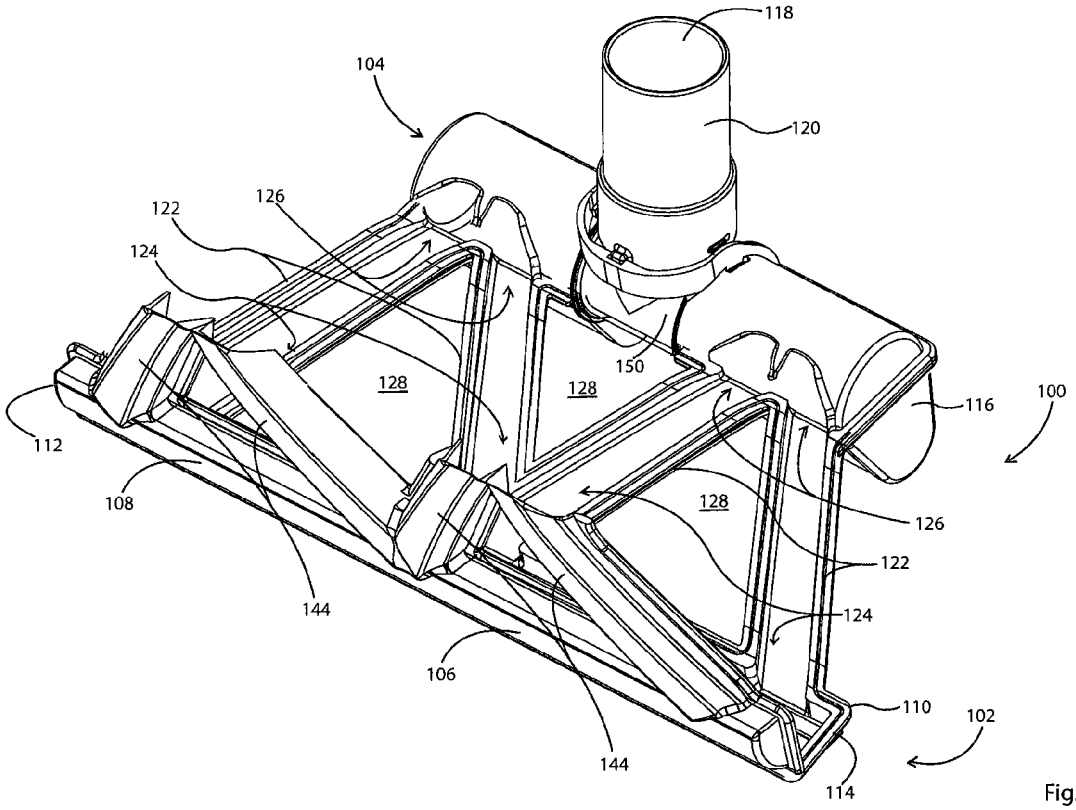
FIGS. 11A-11F are perspective views of alternate embodiments of a surface cleaning head of the present invention, showing alternate configurations of a clean out port.
Figure 11B:
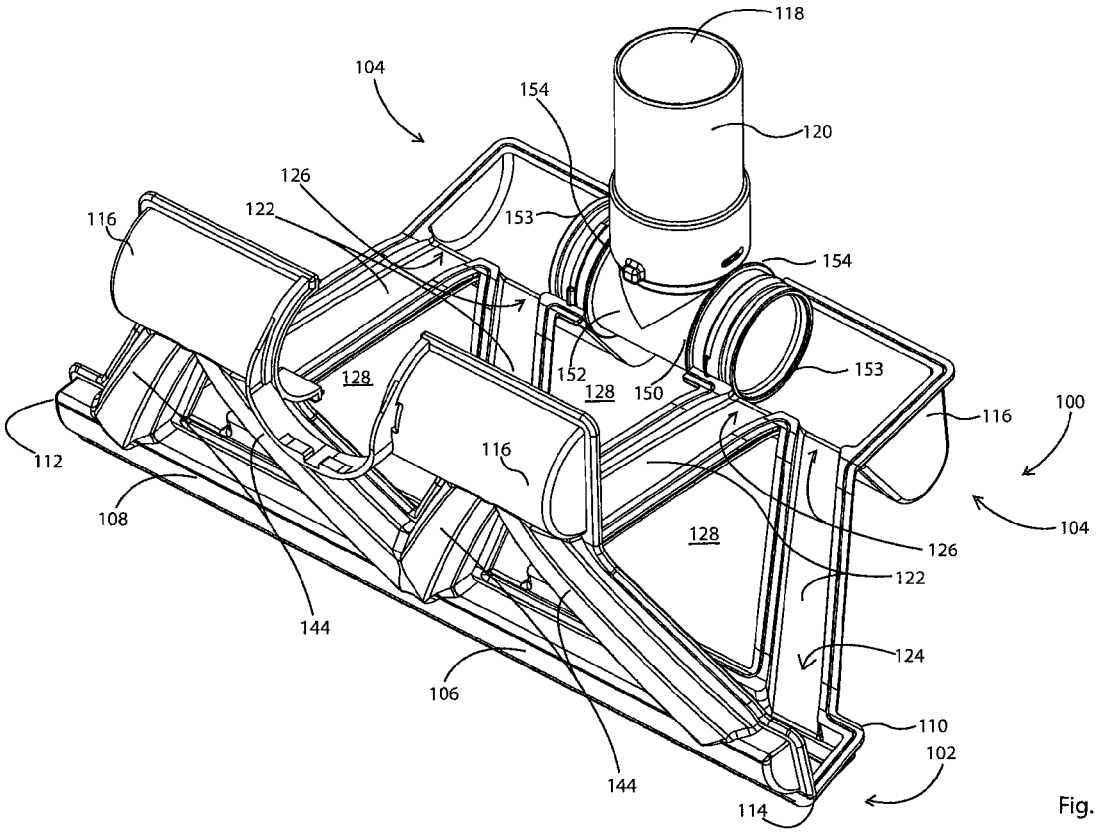

The exemplified embodiment of FIG. 11B is similar to that of FIG. 11A except that the top portion of rear chamber 116 also opens concurrently with the struts 122. In this embodiment the part that pivots open is essentially the top half of the surface cleaning head and the bottom half of the surface cleaning head essentially remains in place. Thus, a type of clam shell design is used. This embodiment is advantageous since pivoting connector 150 is removable when the upper clam shell portion is pivoted open. It will be appreciated that the upper clam shell portion may be removably mounted and not just pivotally mounted to the lower clam shell portion.

Figure 11C:
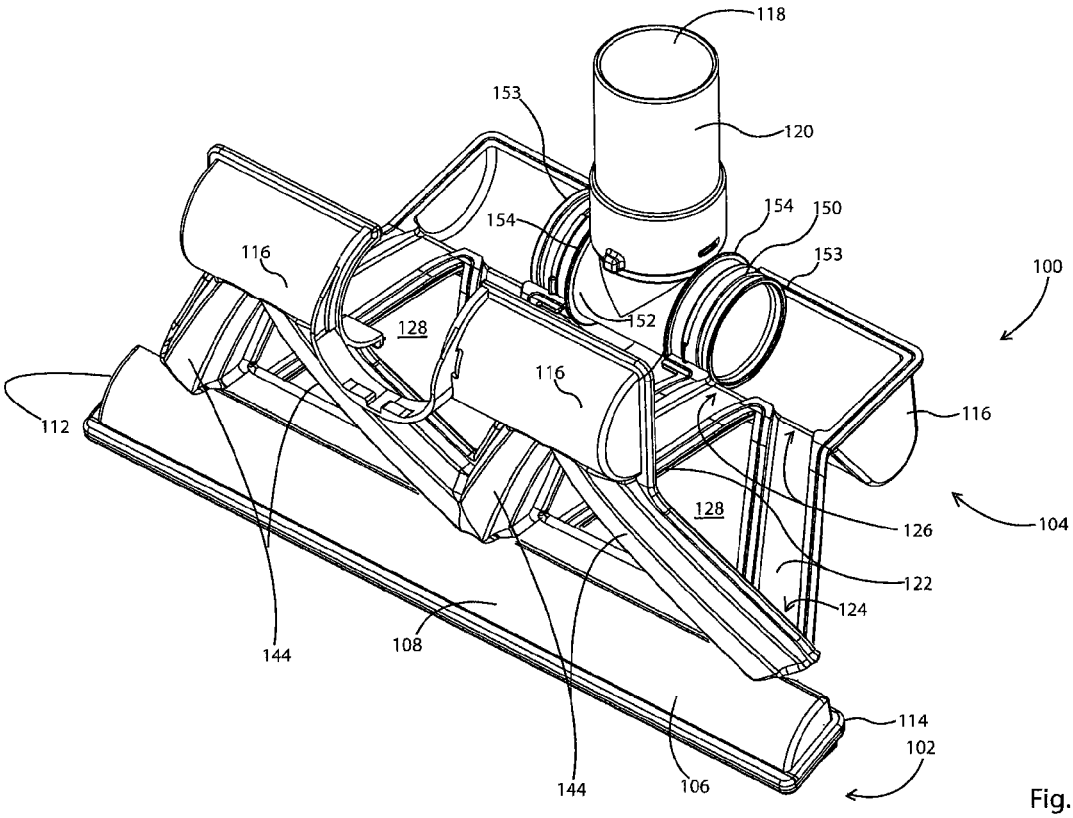

The exemplified embodiment of FIG. 11C is similar to that of FIG. 11B except that the top portion 108 of front chamber 116 remains closed. The openable upper clam shell portion is pivoted at the rearward end of front chamber 106.

Figure 11D:
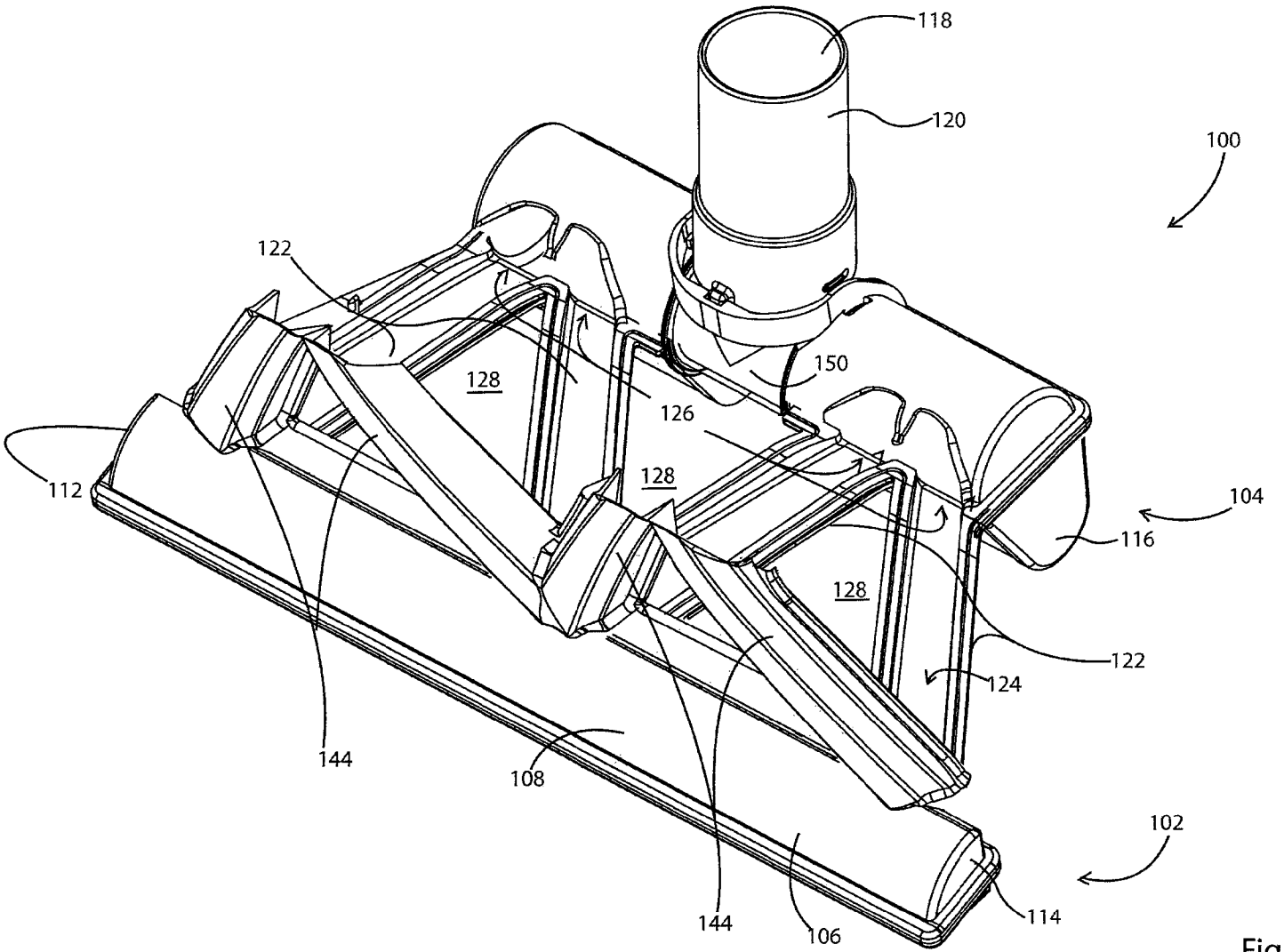

The exemplified embodiment of FIG. 11D is similar to that of FIG. 11A except that the top portion 108 of front chamber 116 remains closed. The openable upper clam shell portion is pivoted at the rearward end of front chamber 106.

Figure 11E:
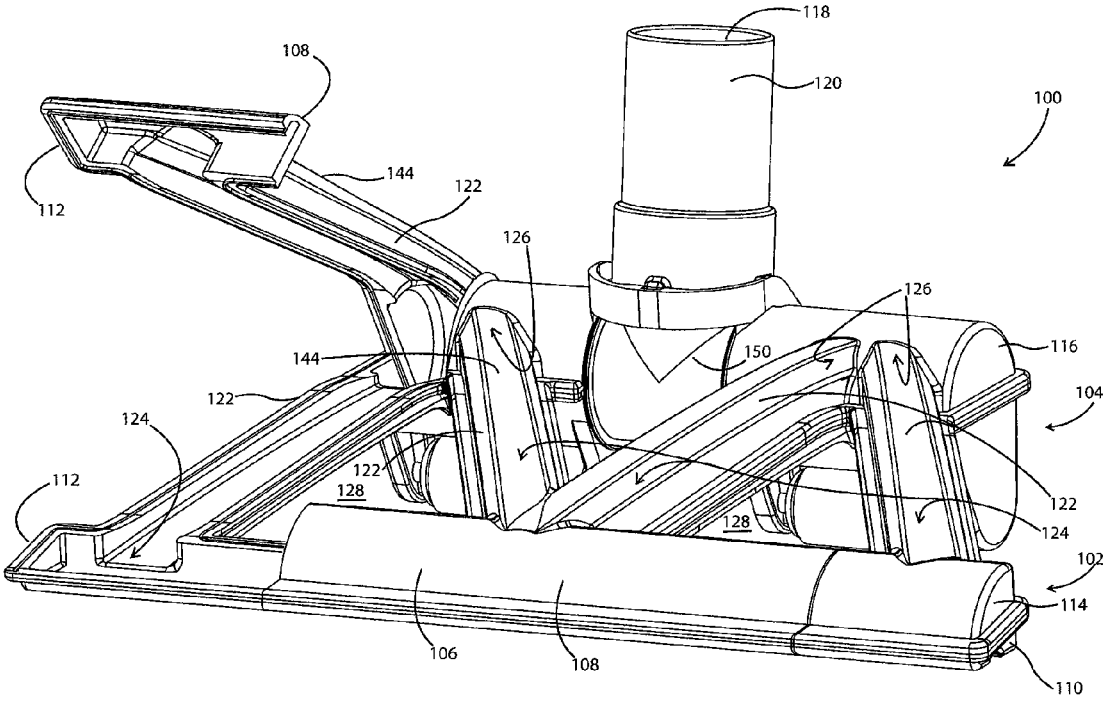

In the exemplified embodiment of FIG. 11E, the openable portion pivots about the rearward end of rear chamber 116. In this embodiment, three openable portions are provided. The left side strut 122, when viewed from the front, is shown in the open position. Similarly, the right side strut 122, when viewed from the front, may be opened independently. Also, the middle portion may be opened independently.

Figure 11F:
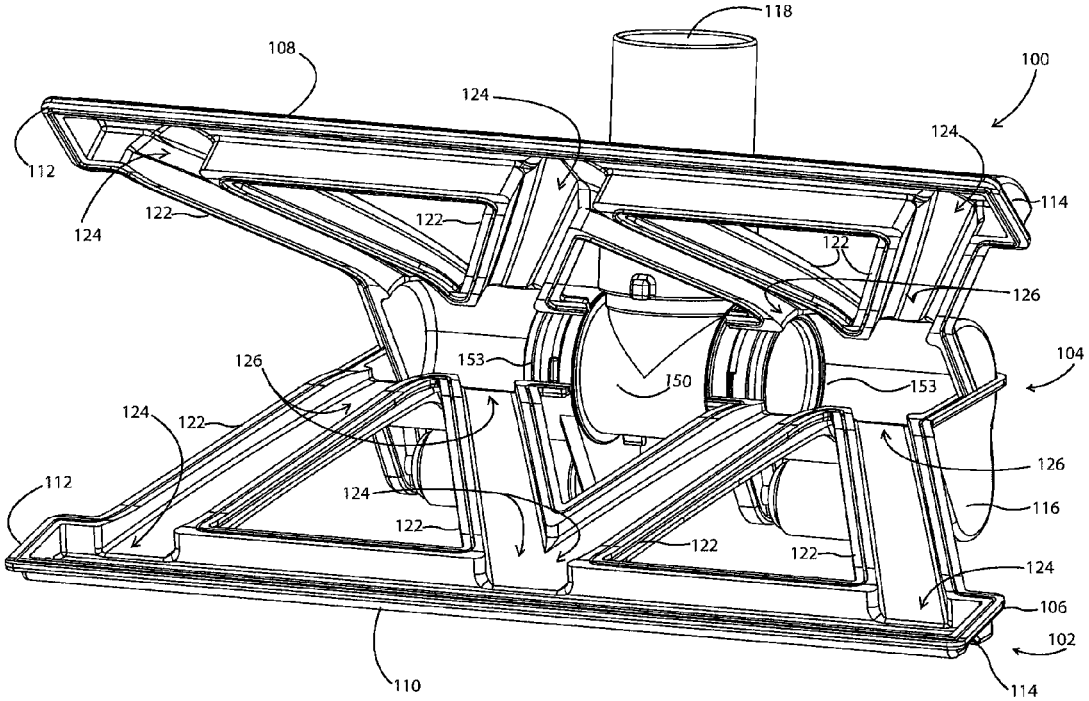

The exemplified embodiment of FIG. 11F is similar to that of FIG. 11E except that the upper clam shell portion is a single construction that pivots open about the rear of rear chamber 116, which pivot axis is shown in FIG. 13.

It will be appreciated any portion may be pivotally or removably mounted to another portion to provide a access for cleaning one or more of the struts 122, front chamber 106 and/or rear chamber 116. Further, any latch or securing means known in the art may be used, including a snap fit, mechanical fasteners such as screws, clamps and the like, a releasable adhesive, and the like. Further, in any of these embodiments, a gasket (not shown) may be provided between top surfaces 144 and struts 122, or any mating parts that open, so that top surfaces 144 may be sealingly connected to struts 122.

Figure 12:
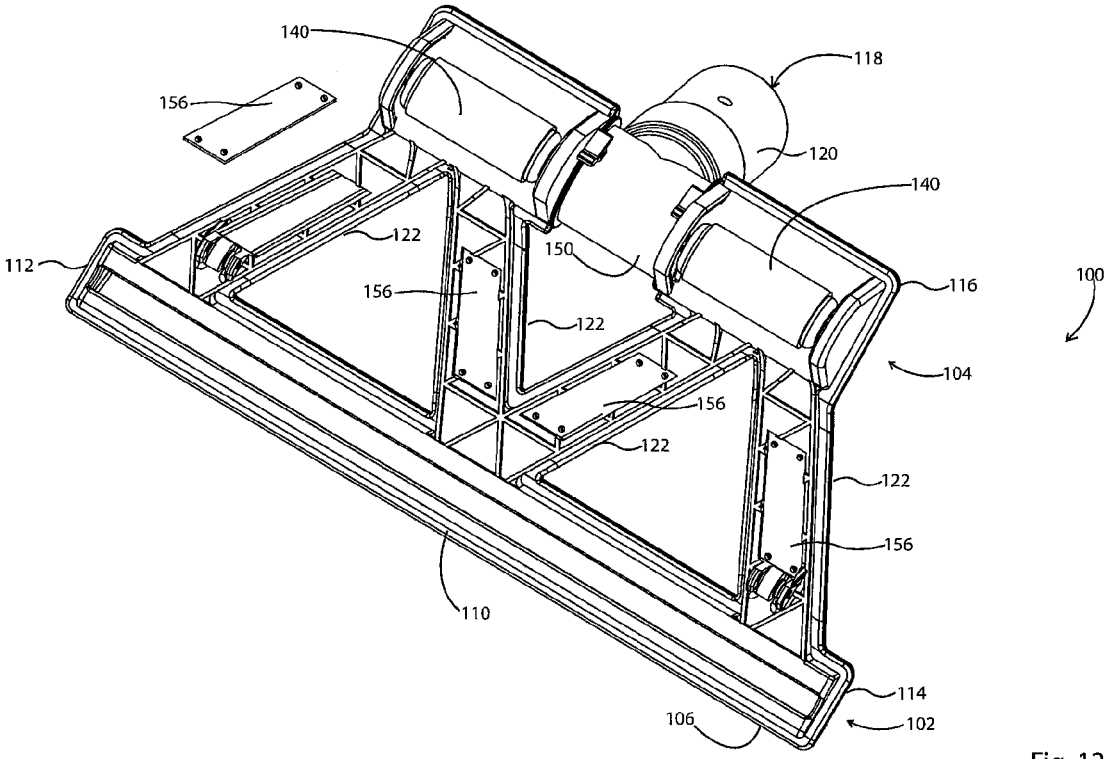
FIG. 12 is a bottom perspective view of an alternate embodiment of a surface cleaning head of the present invention, showing an alternate configuration of a clean out port; and, FIG. 13 is a rear plan view of the embodiment of FIG. 11F.

In alternate embodiments, clean out ports may be provided in another manner. For example, front chamber 106 may be removable from struts 122, such that each intake portion 124 acts as a clean out port. In another example, as shown in FIG. 12, a lower surface of one or more struts 122 may comprise a portion 156 that is openable or removable to provide a clean out port. In yet another example, as shown in FIG. 5, top portion 146 and bottom portion 148 of surface cleaning head may be separable from each other, which may allow a user to clean out blockages from front portion 102, rear portion 104, and pivoting connector 150.

Cleaning head 100 may be fabricated from a variety of materials, and by a variety of methods. For example, cleaning head 100 may be fabricated from one or more of metal alloys, resins, and plastics, or reinforced materials such as fiberglass and carbon fiber reinforced polymers. Some such materials may serve to improve the structural integrity of cleaning head 100 if it does not include an outer casing.

Figure 5:
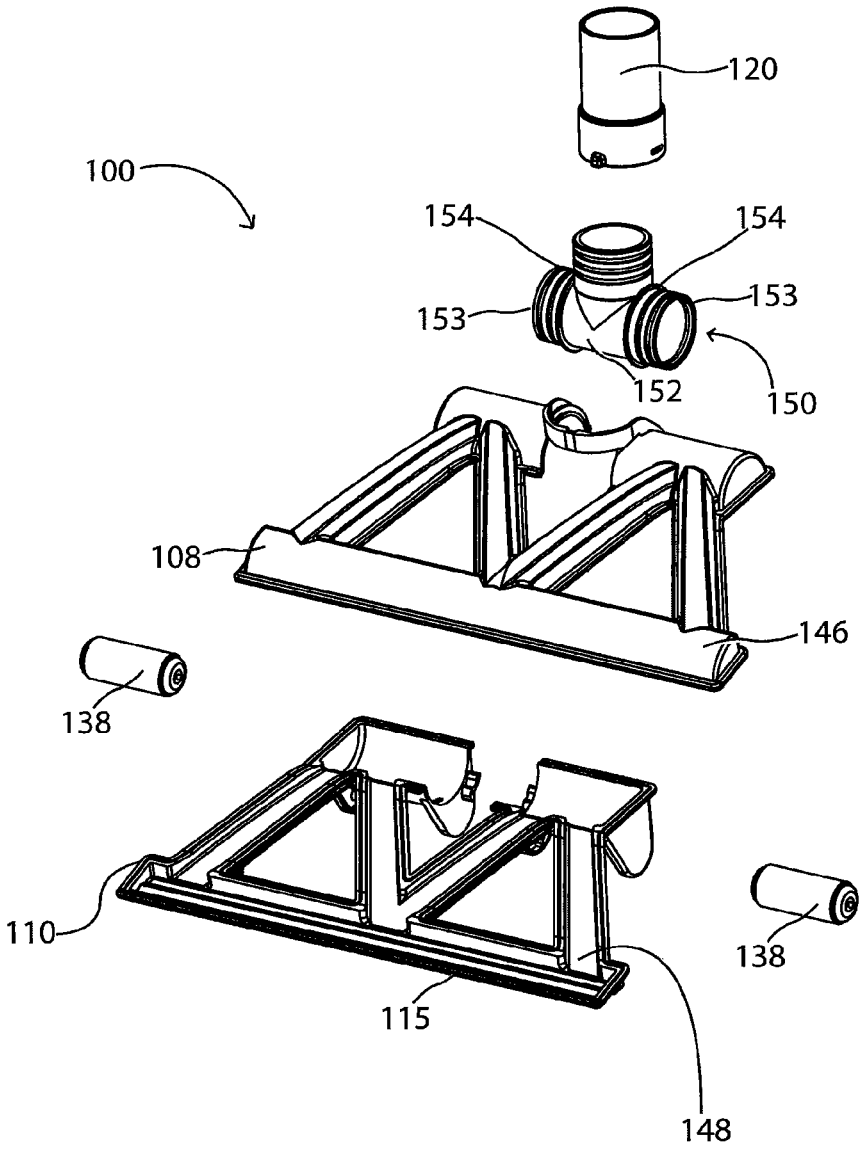
FIG. 5 is an exploded view of a cleaning head of FIG. 1.

Referring to FIG. 5, in the preferred embodiment, cleaning head 100 comprises an upper portion 146, and a lower portion 148, which are separately fabricated from, e.g., a molded plastic. In may be assembled as follows. Brushes 138 may be placed between upper portion 146 and lower portion 148 at front portion 102. A pivoting connector 150 may be connected to rear portion 104, between rear chamber 116 and neck 120, by positioning a transverse portion 152 thereof between upper portion 146 and lower portion 148, and optionally positioning an O-ring or other sealing member between transverse portion 152 and upper portion 146 and lower portion 148. In this embodiment, pivoting connector 150 includes a cavity, and dirt and/or fluid passes from rear chamber 116 and through pivoting connector 150 to an up flow duct. In this embodiment, any additional components may be positioned between upper portion 146 and lower portion 148. Upper portion 146 and lower portion 148 may then be joined. In some embodiments upper portion 146 and lower portion 148 may be joined using mechanical fasteners, such as screws. In such embodiments, upper portion 146 and lower portion 148 may be manufactured with integral screw ports (not shown). Furthermore, a gasket (not shown) may be positioned between upper portion 146 and lower portion 148 to provide an air-tight seal therebetween. In alternate embodiments, upper portion 146 and lower portion 148 may be sealingly connected together by using an adhesive, a snap connector or welding.

Figure 6:
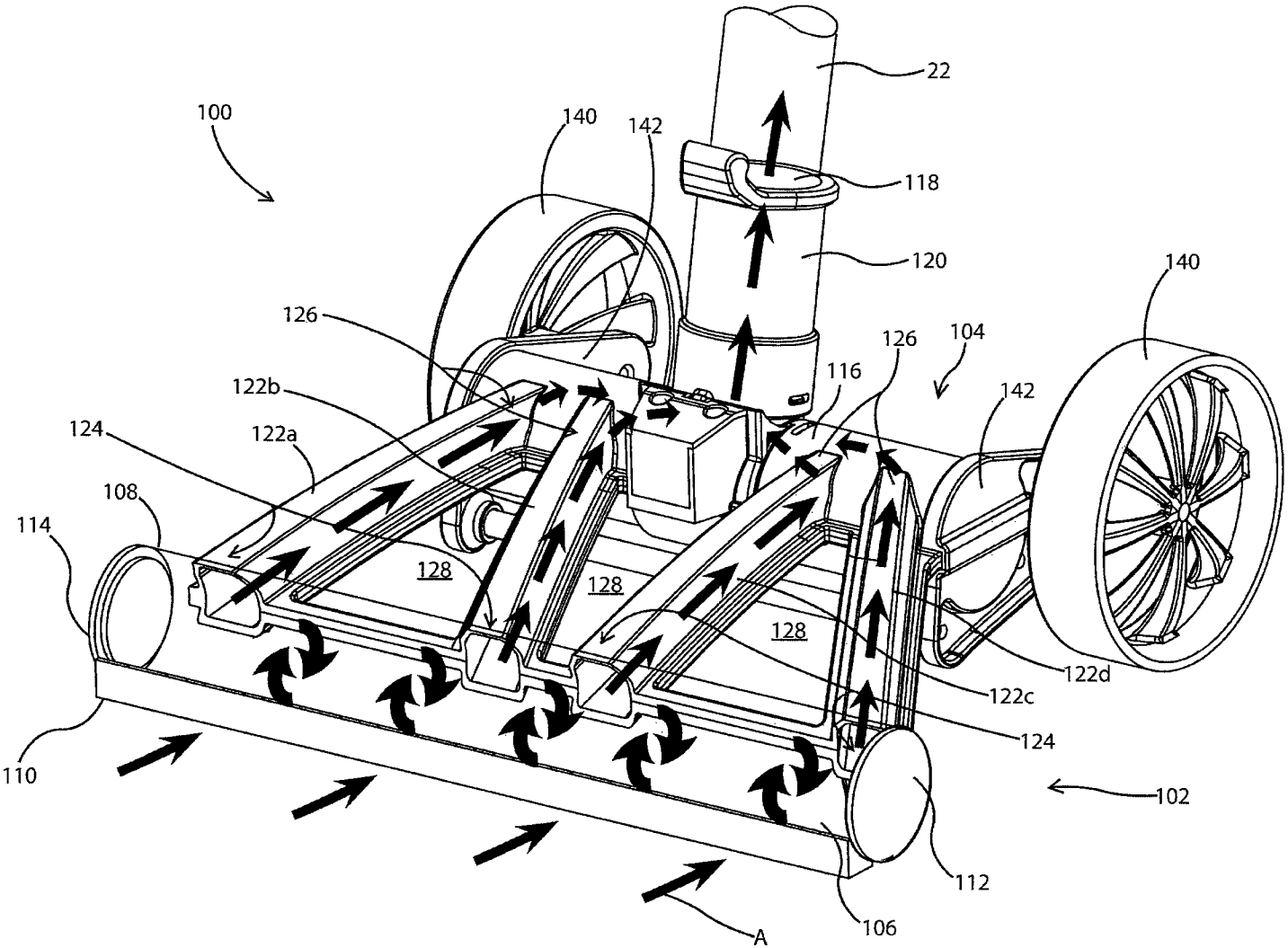
FIG. 6 is a perspective view of another embodiment of a cleaning head of the present invention, showing a fluid flow pathway.
Figure 7:
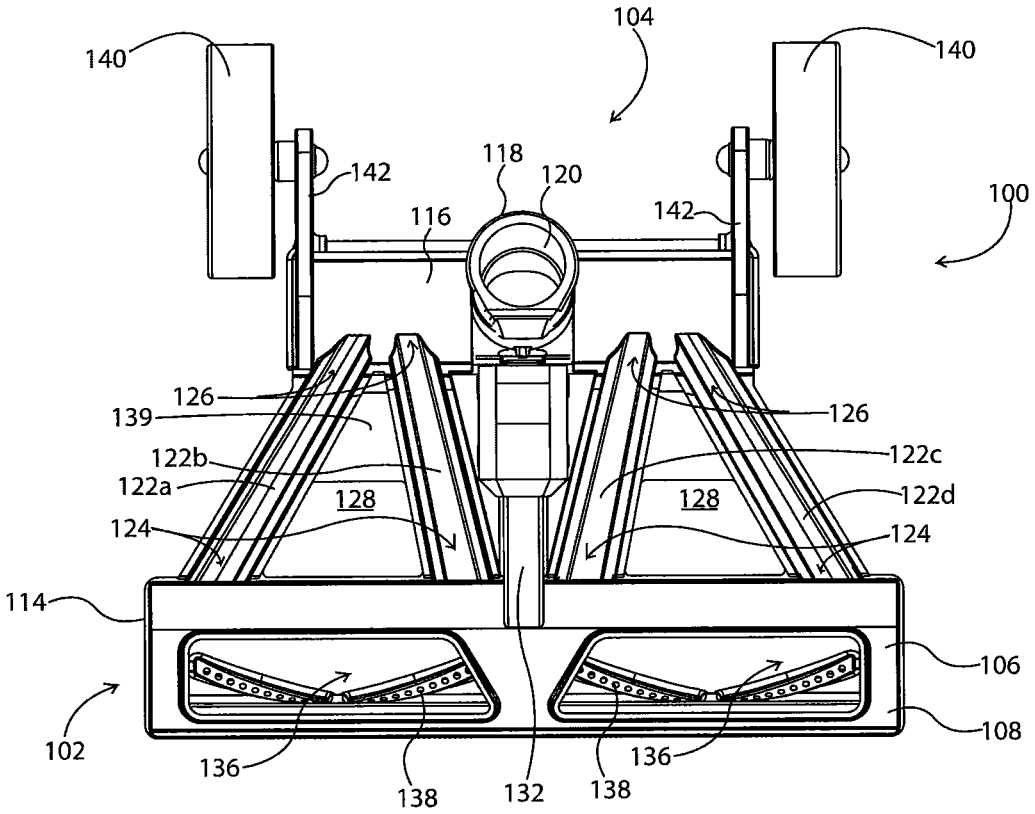
FIG. 7 is a top view of the embodiment of FIG. 2.
Figure 8:
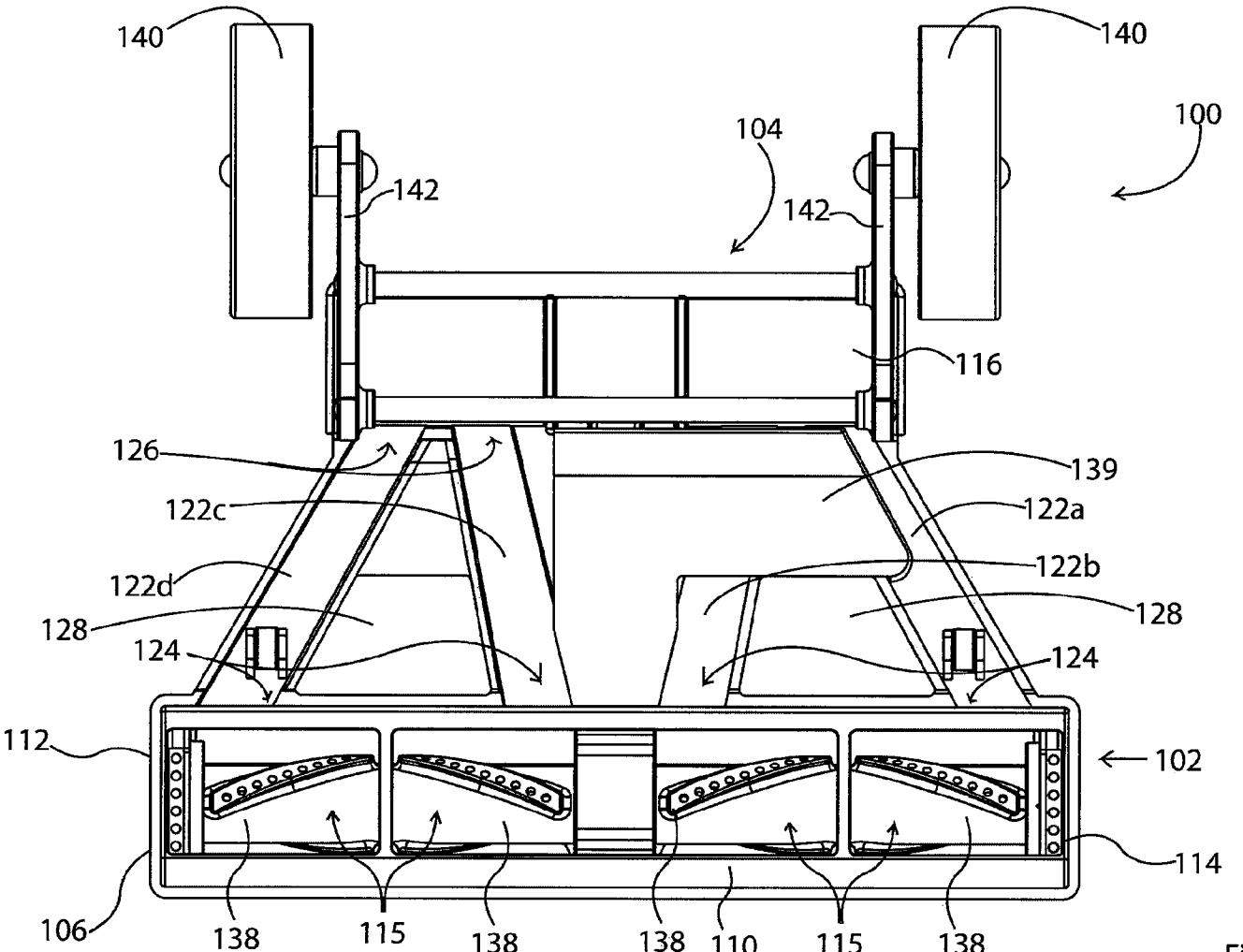
FIG. 8 is a bottom view of the cleaning head of FIG. 7.

In use, cleaning head 100 may be mounted to any surface cleaning apparatus in the art. When the surface cleaning apparatus is actuated (i.e. when a motor is turned on), suction generated by a suction motor 18 causes fluid to enter cleaning head 100 via dirty fluid inlet 115. Referring to FIG. 6, an exemplary pathway followed by the fluid through cleaning head 100 is shown by arrows A. The fluid enters front chamber 106 and circulates therein. The fluid passes into the intake portions 124 of struts 122*a*, 122*b*, 122*c*, and 122*d*, and exits through outlets 126. The fluid then enters rear chamber 116, and passes into neck 120 via pivoting connector 150. From neck 120, fluid passes into backbone 22, which directs the fluid to cyclone 120 for removal of the dirt entrained therein.

Thus, embodiments of the present invention provide a cleaning head for a surface cleaning apparatus that may be relatively light and low-cost, may operate even if a blockage occurs, and may allow a user to better visualize a surface to be cleaned.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

I claim:

1. A cleaning head for a surface cleaning apparatus, comprising:

(a) a front portion having at least one dirty fluid inlet, a front, a first side, a spaced apart second side and a transverse length between the first and second sides;

(b) a rear portion connectable to a surface cleaning apparatus and having at least one dirty fluid outlet; and, (c) a plurality of rigid struts extending between the front portion and the rear portion, at least one of the struts comprises an air-flow passage extending between the front portion and the rear portion and at least two adjacent struts being at least partially spaced apart by a distance and defining an open area between the at least two of the adjacent struts, the open area being substantially devoid of operating components of the cleaning head, wherein the transverse length is greater than the distance;

whereby when the cleaning head is positioned on a surface, the surface is visible through the open area.

2. The cleaning head of claim 1, wherein at least two of the struts each comprise an air-flow passage extending between the front portion and the rear portion.

3. The cleaning head of claim 1, wherein the front portion has a longitudinally extending front chamber and each strut that defines an airflow passage comprises an intake portion in flow communication with the longitudinally extending front chamber.

4. The cleaning head of claim 3, wherein at least two of the struts comprises an air-flow passage extending between the front portion and the rear portion, each strut that defines an air flow passage having an intake portion and the intake portion of each strut that defines an airflow passage is spaced from the intake portion of at least one other strut.

5. The cleaning head of claim 4, wherein the rear portion has a longitudinally extending rear chamber and each strut that defines an airflow passage further comprises an outlet in flow communication with the longitudinally extending rear chamber.

6. The cleaning head of claim 5, wherein at least two of the struts comprises an air-flow passage extending between the front portion and the rear portion, each strut that defines an air flow passage having an outlet and the outlet of each strut is spaced from the outlet of at least one other strut.

7. The cleaning head of claim 5, wherein the longitudinally extending rear chamber is circular in transverse section.

8. The cleaning head of claim 5, wherein at least a portion of the longitudinally extending rear chamber is rotationally mounted in the cleaning head about a longitudinally extending axis.

9. The cleaning head of claim 1, wherein the cleaning head comprises between 2 and 8 struts.

10. The cleaning head of claim 9, wherein the plurality of struts are arranged to define an M.

11. The cleaning head of claim 1, wherein the cleaning head comprises 4 struts, each comprising an airflow passage.

12. The cleaning head of claim 1, wherein at least some of the struts that define an airflow passage have a viewing portion with a visibility such that a user can view the interior thereof.

13. The cleaning head of claim 12, wherein the viewing portion is transparent.

14. The cleaning head of claim 12, wherein the viewing portion is provided in a lower surface of the cleaning head.

15. The cleaning head of claim 1, wherein at least one of the struts that defines an airflow passage is openable.

16. The cleaning head of claim 15, wherein at least one of the struts that defines an airflow passage has a clean out port.

17. The cleaning head of claim 15, wherein each strut that defines an airflow passage has a clean out port.

18. The cleaning head of claim 1, wherein the front portion has a longitudinally extending front chamber and the front portion comprises a rotatably mounted brush mounted in the longitudinally extending front chamber and a bush drive motor is positioned in a housing external to the front portion, the rear portion and the struts.

19. The cleaning head of claim 18, wherein the cleaning head has surface contacting members that define a plane, at least some of the struts extend upwardly and rearwardly from the front portion to define a space between the at least some struts and the plane and the housing for the brush drive motor is positioned in the space.

20. The cleaning head of claim 1, further comprising rear wheels positioned rearwardly of the rear portion and the dirty fluid outlet.

21. The cleaning head of claim 20, wherein the dirt fluid outlet is rotationally mountable to an upright section of an upright vacuum cleaner.

22. The surface cleaning head of claim 1 further comprising an upper clam shell portion that includes a portion of the at least one strut that comprises an air-flow passage and a lower clam shell portion that comprises at least a portion of that strut.

23. A cleaning head for a surface cleaning apparatus, comprising:

(a) a front portion having at least one dirty fluid inlet;

(b) a rear portion connectable to a surface cleaning apparatus and having at least one dirty fluid outlet;

(c) a plurality of rigid struts extending between the front portion and the rear portion, at least one of the struts comprises an air-flow passage extending between the front portion and the rear portion and at least two adjacent struts being at least partially spaced apart; and, (d) a fully enclosed open area that is surrounded by the at least two of the adjacent struts, the front portion and the rear portion, the open area being substantially devoid of operating components of the cleaning head, whereby when the cleaning head is positioned on a surface, the surface is visible through the open area.

24. The cleaning head of claim 23, wherein at least two of the struts each comprise an air-flow passage extending between the front portion and the rear portion.

25. The cleaning head of claim 23, wherein the cleaning head comprises between 2 and 8 struts.

26. The cleaning head of claim 23, wherein at least some of the struts that define an airflow passage have a viewing portion with a visibility such that a user can view the interior thereof.

27. The cleaning head of claim 26, wherein the viewing portion is transparent.

28. The cleaning head of claim 26, wherein the viewing portion is provided in a lower surface of the cleaning head.

29. The cleaning head of claim 23, wherein at least one of the struts that defines an airflow passage is openable.

30. The cleaning head of claim 29, wherein at least one of the struts that defines an airflow passage has a clean out port.

31. The cleaning head of claim 29, wherein each strut that defines an airflow passage has a clean out port.

32. The cleaning head of claim 23, wherein the front portion has a longitudinally extending front chamber and the front portion comprises a rotatably mounted brush mounted in the longitudinally extending front chamber.

* * * * *